United States Patent [19]

Tanaka et al.

[11] 4,385,425

[45] May 31, 1983

[54] BUCKLING DEVICE FOR VEHICLE SEAT BELT

[75] Inventors: Koubun Tanaka, Nagoya; Takashi Kawaharazaki, Toyoake, both of Japan

[73] Assignee: Kabushiki-Kaisha, Tokai-Rika-Denki-Seisakusho, Aichi, Japan

[21] Appl. No.: 276,919

[22] Filed: Jun. 24, 1981

[30] Foreign Application Priority Data

Jun. 30, 1980 [JP] Japan ..... 55-92231[U]

[51] Int. Cl.[3] ..... A44B 11/26

[52] U.S. Cl. ..... 24/230 A

[58] Field of Search ..... 24/230 A, 230 AL

[56] References Cited

U.S. PATENT DOCUMENTS 4,195,392 4/1980 Veda et al. ..... 24/230 A

*Primary Examiner*—Hugh R. Chamblee

*Attorney, Agent, or Firm*—Carroll F. Palmer

[57] ABSTRACT

A buckling device for a vehicle seat belt comprises a locking portion arranged within a buckle so as to lock a tongue plate, a lock controlling mechanism to selectively hold said locking in a locked position where it is engageable with said tongue plate and in an unlocked position where it is unengageable with said tongue plate, and an actuating unit to dislodge the locking condition between said tongue plate and said locking portion. With the structure as stated, the lock controlling mechanism is adapted to move said locking portion from the unlocked position to the locked position associated with the inserting operation of said tongue plate into said buckle, while return said locking portion to the original unlocked position associated with the unlocking operation by unit of said actuating means.

1 Claim, 7 Drawing Figures

BUCKLING DEVICE FOR VEHICLE SEAT BELT

BACKGROUND OF THE INVENTION

This invention relates to a buckling device for connecting vehicle occupant restraint belts.

In the prior art, a buckling device of related type comprises a locking means disposed in a frame so as to be always spring urged in the direction of a tongue plate having an aperture is to be locked. The prior art construction is such that when the tongue plate is inserted into the frame, the tongue plate brings the peripheral end of said aperture into engagement with said locking means to lock the tongue plate. With the inserting of the tongue plate into the frame, however, the tongue plate is exposed to a clamping-like force between the frame and the locking means so that the locking means is likely held in the clamped condition even though the inserting operation is suspended on its way. Hence, the locking means tightly contacts with the surface of the tongue plate even before the tongue plate is locked. Because of, as it were, the spuriously locked condition, it should be apparent that an occupant can mistakenly finish the locking operation with the tongue plate incompletely locked.

In consequence, there is the possible hazard that occupant restraint belts can be easily disconnected so that the vehicle occupant would get seriously injured at the time of collision or the like.

On the other hand, when the buckle means is wholly subjected to a strong impact for some unknown cause, there is also the of danger that the locking means can accidentally get out from the aperture of the tongue plate to dislodge the locked tongue plate.

OBJECTS

Accordingly a first object of the invention is to provide a buckling device for vehicle seat belt wherein the occurrence of the spuriously locked condition is prevented before a tongue plate moves to a position engageable with a locking means when the plate is inserted into a frame, therefore avoiding the danger that the unlocked condition is mistaken for the locked condition since the latter is securely distinguished from the former.

A second object of the invention is to provide a buckling device for vehicle seat belt wherein under the condition that a tongue plate is locked by a locking means, the locked condition is prevented from being easily dislodged even if a strong tensile force and/or a strong impact force is applied to a seat belt and/or the whole buckling device at the time of, for example, collision.

A third object of the invention is to provide a convenient buckling device for use wherein as soon as a tongue plate is unlocked, the plate is ejected from the buckling means.

BRIEF DESCRIPTION OF THE DRAWINGS

Further objects, advantages and other novel features of the invention will be manifest to those skilled in the art as a description thereof proceeds with reference to the accompanying drawings in which.

DESCRIPTION OF THE PREFERRED EMBODIMENTS

Figure 1:
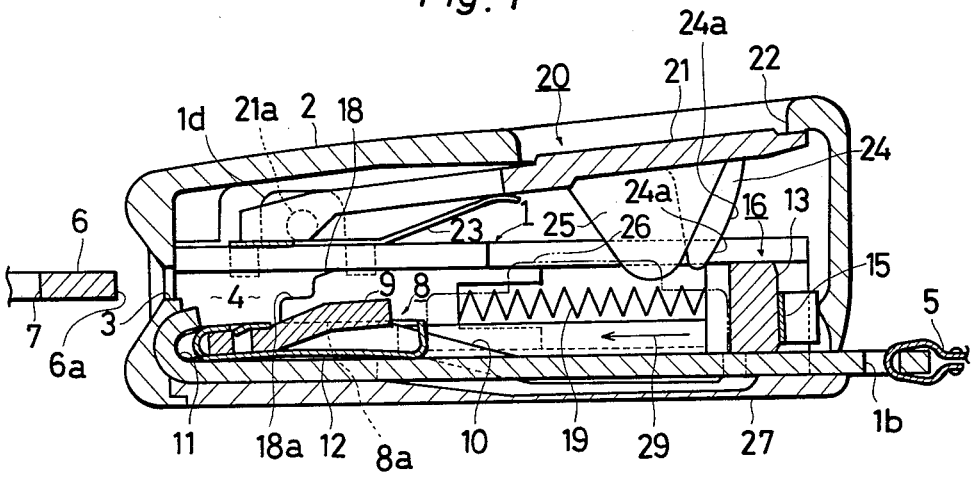
FIG. 1 is a longitudinal cross sectional view of a buckling device in accordance with a preferred embodiment of the invention.
Figure 2:
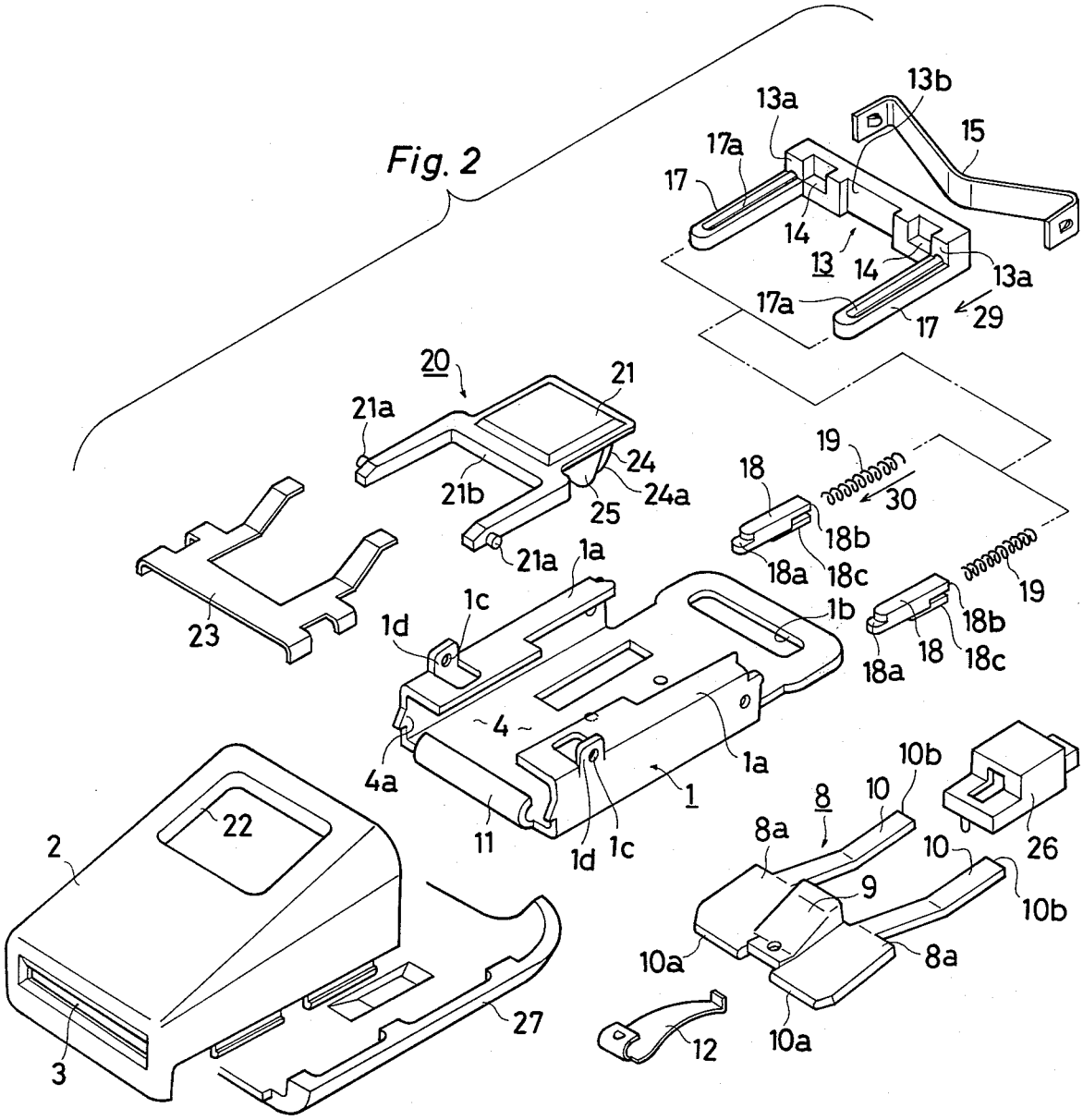
FIG. 2 is an exploded perspective view of said buckling device.
Figure 5:
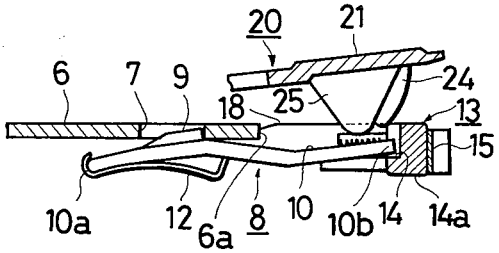

Referring now to the drawings in detail, a lower open ended cover 2 of a buckling device is a frame, generally indicated at 1, disposed both sides of which are respectively inturned to form a angular guideways 1*a* and the inner spatial area of the frame 1 is adapted to form a passageway 4 communicated with a guide slot 3 provided in the left end of the cover 2, while one end of the frame 1 in the opposite side of the slot 3 has an opening 1*b* to which a webbing 5 is secured. The cover 2 is closed at the lower open end by a lid plate 27. A tongue plate 6 is secured at one end to a seat belt substantially anchored to a vehicle body, while the other portion 6*a* of the plate 6 is provided with an aperture 7 to serve as an engaging means and the tongue plate 6 is to be inserted into the passageway 4 through the slot 3 of the cover 2. Within the frame 1 is a locking means 8 which is formed by punching a steel sheet metal so as to carry a middle bulged locking portion 9 which is to interfit into the aperture 7 as shown in FIG. 5 and a couple of leg pieces 10 each laterally extending from both sides of the locking portion 9. Said locking means 8 is rotatably engaged at one end 10*a* with a semi-circularly enrolled receptacle 11 provided in the ingress end 4*a* of the passageway 4 so that the locking means 8 may rotate about the end portion 10*a* between FIG. 3 horizontal unlocked position where the tongue plate is freely passable through the passageway 4 and FIG. 5 locked position where the locking portion 9 interfits into the aperture 7. The locking means 8 is usually urged toward the locked position by means of a spring leaf 12 arranged beneath the locking portion 9. Within the guideways 1*a* of the frame 1 is an almost U-shaped engaging means 13 slidably mounted, the bight portion of which has a pair of offset sections 14 so as to be respectively in registry with the leg pieces 10. Said engaging means 13 comprises a lock controlling mechanism 16 in cooperation with a leaf spring (a second spring means) 15 which always biases the engaging means 13 to move in the arrowed direction 29 so that the engaging means 13 is normally held in the horizontal unlocked position with the end portion 10*b* of the leg piece 10 engaging the lower section of the engaging means 13 (Abbreviated as engaged position hereinafter). Both extensions 17 of the engaging means 13 are reduced in thickness to form an offset area 13*a* and an upper lengthwise guidegroove 17*a* where a spring-loaded actuator 18 is slidably mounted, the biasing force of which is predetermined smaller than that of the leaf spring 15. Said actuator 18 has an offset portion 18*a* at the top end to correspond with the end portion 6*a* of the tongue plate 6 and a relatively shorter sliding block 18*c* at the lower surface which is slidably interfit into the groove 17*a*. In this situation, the top end of the actuator 18 is slightly overhung from the toe portion of the U-shaped engaging means 13 to ride on a shoulder 8*a* defined by bending the leg piece 10 and the actuator 18 itself is biased in the arrowed direction 30 by the effort of a compressive coil spring (a first spring means) 19 as seen in FIG. 1.

On the other hand, when the tongue plate 6 is inserted into the slot 3, the plate 6 initially engages the offset portion 18*a* to slide the actuator 18 along the groove 17*a* in the counterarrowed direction 30 until the end portion 18*b* engages the offset area 13*a* of the engaging means 13. Subsequently the engaging means 13 is moved from the engaged position in the counterarrowed direction 29 against the effort of the leaf spring 15. A push button 20 carries a push plate 21 and a U-shaped arm 21*b* having outwardly projected pins 21*a* at its toe portions. The pins 21*a* are respectively journalled for rotation at the hole 1*c* provided in lugs 1*d* rising upwardly frm the guideway 1*a*. Said push button 20, which serves as an actuating means, is normally spring urged upwardly by a spring leaf 23 with the push plate 21 looking up an opening 22 defined in the cover 2. A cam portion 24 having a cam face 24*a* and a couple of projections 25, which respectively act as a first and second press means, are each secured to the lower surface of the push plate 21 so as to be in registry with the middle bight portion 13*b* of the engaging means 13 and the leg pieces 10. On the inner bottom of the frame 1 is a switching device 26 mounted which is to be activated when the tongue plate 6 encounters the locking portion 9.

With the structure thus far described, it should be apparent that an operator can insert the tongue plate 6 into the passageway 4 through the slot 3 and as a consequence, the plate 6 engages the offset portion 18*a* of the actuator 18 through the end portion 6*a* to move the actuator 18 toward a first position in the counterarrowed direction 30 against the effort of the spring 19 so that the tongue plate 6 advances deeper into the passageway 4.

Figure 3:
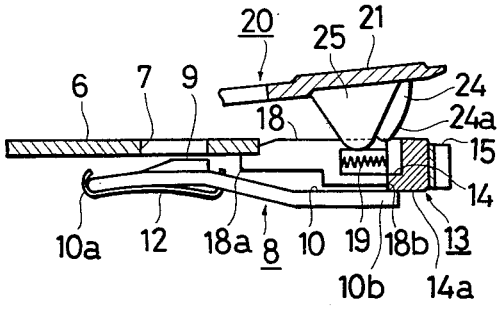
FIGS. 3–7 are lateral sectional views for explaining operation of said buckling device with both the cover and frame removed.

At this time, the tongue plate 6 passes the passageway 4 without being obstructed by the locking portion 9 due to the fact that the leg piece 10 engages the lower surface 14*a* of the engaging means 13 though the end portion 10*b* so as to be located in the horizontal unlocked position as seen in FIG. 3, although the locking means 8 is ever spring urged in the upward counterclockwise direction. When the tongue plate 6 is further inserted to such an extent that the actuator 18 engages the offset area 13*a* of the engaging means 13 through the rear end 18*b* to move the engaging means 13 from the first position to a second position in the counterarrowed direction 29 against the effort of the leaf spring 15, the engaging means 13 disengages from the lower surface 14*a* so that the locking means 8 rotates in the upward counterclockwise direction 28 as seen in FIG. 4 by the effort of the spring leaf 12, while the locking portion 9 interfits into the aperture 7 to lock the tongue plate 6.

Figure 4:
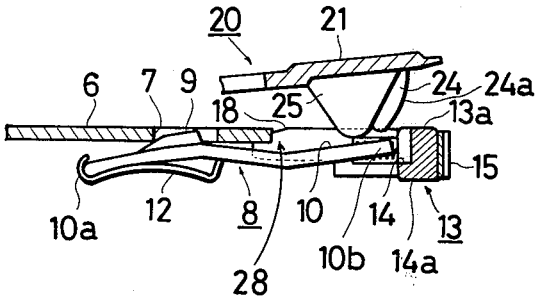

Upon release of the tongue plate 6, as is readily understood by the movement from FIG. 4 position to FIG. 5 position, the end portion 10*b* of the leg piece 10 interfits into the offset section 14 of the engaging means 13 to prevent the downward clockwise movement of the leg piece 10.

In this situation, even if the buckling device is exposed to a strong impact, the locking means 8 is prevented from rotating in the downward clockwise direction 28 in the fact that the leg piece 10 interfits into the offset section 14 as aforementioned so that the tongue plate 6 is securely prevented from being accidentally unlocked.

Figure 6:
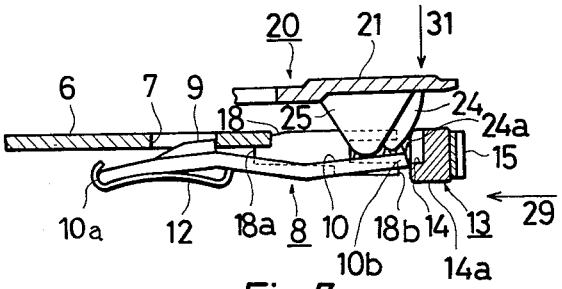

In order to unlock the tongue plate 6, it should be also apparent that the operator can manually depress the push button 20 in the arrowed direction 31 shown in FIG. 6 and as a consequence, the cam face 24*a* of the cam portion 24 initially engages the middle bight portion 13*b* of the engaging means 13 to move the engaging means 13 in the counterarrowed direction 29 in FIG. 6 so as to get the leg piece 10 out of the offset section 14. Subsequently the projection 25 engages the leg piece 10 to lower it against the effort of the spring leaf 12 so that the locking portion 9 may get out of the aperture 7 to release the tongue plate 6.

Figure 7:
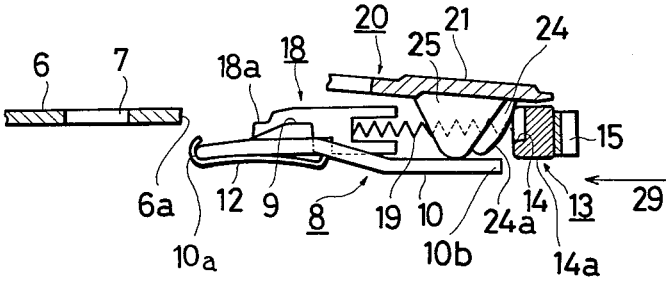

As soon as the tongue plate 6 is released in this manner, the tongue plate 6 is forcibly ejected from the frame 1 due to the fact that the actuator 18 is moved back in the arrowed direction 29 shown in FIG. 7 by the effort of the spring 19 to pass on the shoulder 8*a*.

Upon release of the push button 20, the button 20 returns to the original position by the effort of the spring leaf 23, while the locking means 8 rotates, though slightly, in the counterclockwise direction until the shoulder 8*a* engages the actuator 18 so that the locking means 8 is prevented from further rotating to be held in FIG. 7 position. At this time, the engaging means 13 moves back in the counterarrowed direction 29 as if sliding on the end portion 10*b* of the leg piece 10 so that the engaging means 13 returns to the original engaged position.

Pursuant to the embodiment of the invention, even if the inserting operation of the tongue plate 6 is suspended on its way prior to being locked, the released tongue plate 6 is immediately expelled from the frame 1 by the biasing force of the spring 19 since the tongue plate 6 is, as it were freed, not being obstructed by the locking means 8 in the inserting process.

In this way, the released tongue plate 6 in the inserting process is invariably ejected from the frame 1 so that an operator can securely distinguish the unlocked condition from the locked condition.

This fact eliminates the accidentally or spuriously locked condition of the tongue plate 6 so that the operator may not inadvertently finish the inserting operation of the tongue plate 6 under non-locked condition.

Furthermore, even if the cover 2 is accidentally removed from the frame 1, the only depressed operation of the push button 20 readily functions to unlock the tongue plate 6 for safty since both the push button 20 and the spring leaf 23 are mounted on the frame 1. Obviously the invention is susceptible to changes or alterations without defeating its practicability, therefore, we do not wish to be confined to the preferred embodiment shown in the drawings and described herein.

It is claimed:

1. A buckling device for vehicle seat belts comprising:

tongue means having an engaging means, frame means having an inner passageway into which said tongue means is to be inserted, locking means movably disposed in said passageway between an locked position with said engaging means and an unlocked position away from said engaging means and usually urged toward said locked position by first spring means, a lock controlling mechanism movably mounted on said frame means and holding said locking means in said unlocked position when said locking means is moved to said unlocked position against the effort of said first spring means and allowing said locking means to move toward said locked position, being moved when said tongue means is inserted into said passageway, and actuating means to dislodge said locking means in the locked position, said lock controlling mechanism comprising:

an actuator mounted on said passageway in said frame means so as to be moved from a first position to a second position against the effort of second spring means when said tongue means is inserted into said passageway, and engaging means for movement from an engaged position with said locking means to a disengaged position from said locking means against the effort of third spring means when said actuator is further moved from the second position by said tongue means, whereby said engaging means serves to selectively hold said locking means in the locked position and the unlocked position, while said actuator acts to hold said locking means in the unlocked position independent of said engaging means at said second position.

* * * * *